US007310621B2

(12) United States Patent
Charroppin

(10) Patent No.: US 7,310,621 B2
(45) Date of Patent: Dec. 18, 2007

(54) SYSTEM FOR GUARANTEEING PRINT OF POSTAL INDICIA

(75) Inventor: Pascal Charroppin, Le Vesinet (FR)

(73) Assignee: Neopost Industrie, Bagneux (FR)

( * ) Notice: Subject to any disclaimer, the term of this patent is extended or adjusted under 35 U.S.C. 154(b) by 925 days.

(21) Appl. No.: 10/301,787

(22) Filed: Nov. 22, 2002

(65) Prior Publication Data

US 2003/0126099 A1 Jul. 3, 2003

(30) Foreign Application Priority Data

Dec. 28, 2001 (FR) ..... 01 17004

(51) Int. Cl.
*G07B 17/02* (2006.01)

(52) U.S. Cl. ..... 705/402

(58) Field of Classification Search ..... 705/402
See application file for complete search history.

(56) References Cited

U.S. PATENT DOCUMENTS

| | | | | |
|---|---|---|---|---|
| 5,016,171 | A * | 5/1991 | Connolly et al. | 714/1 |
| 5,021,828 | A | 6/1991 | Yamaguchi et al. | |
| 5,305,199 | A | 4/1994 | LoBiondo et al. | |
| 6,428,132 | B1 * | 8/2002 | Kubatzki et al. | 347/7 |
| 2003/0101099 | A1 * | 5/2003 | Sheltz et al. | 705/26 |

FOREIGN PATENT DOCUMENTS

| | | | |
|---|---|---|---|
| EP | 0 802 059 | A2 * | 10/1997 |
| FR | EP 0 825 57 | A1 | 2/1998 |
| FR | EP 1 103 923 | A1 | 5/2001 |
| WO | WO 97/40480 | | 10/1997 |

OTHER PUBLICATIONS

Anonymous, "HP Extends Printer Warranties," Computer Reseller News, Feb. 12, 1990, p. 78.*

* cited by examiner

*Primary Examiner*—John W. Hayes
*Assistant Examiner*—Nathan H. Erb
(74) *Attorney, Agent, or Firm*—Sughrue Mion, Pllc.

(57) ABSTRACT

This invention relates to a process for recording an extension of guarantee of print for a system for franking mailpieces, comprising a display of an indication of "end of initial guarantee" at the level of the franking system; comparing a remaining volume of ink with a minimum volume of ink beyond which printing of the mailpieces is prohibited; if the remaining volume of ink permits, a display of an indication of "offer of extension of guarantee" at the level of the franking system; if this offer is accepted by the user of the franking system, linking with a server of the franking system distributor; and recording of the extension of guarantee in the distributor's server. The indication of the end of initial guarantee corresponds to the franking of a predetermined number of mailpieces.

11 Claims, 2 Drawing Sheets

SYSTEM FOR GUARANTEEING PRINT OF POSTAL INDICIA

FIELD OF THE INVENTION

The present invention relates to the domain of mail handling, and more particularly to a system for guaranteeing the quality of print of the postal indicia printed by a franking machine.

BACKGROUND OF THE INVENTION

Conventionally, as postal indicia represent a monetary value, the quality of print thereof on mailpieces is primordial in order to avoid any fraud or financial loss for the user in the event of the Postal Service rejecting the franking.

It therefore appears important to be able to guarantee for the users of franking machines, or more generally of all franking systems, conformity of the printed postal indicia to the technical specifications of the Postal Service.

At the present time, the specific postal ink cartridges are sold with a guarantee corresponding to a limited period of use, for example 12 months, or to a limited number of frankings, for example 20000. In the case of users such as dispatch or mail services proceeding with a very large number of frankings daily, it is obviously the second limit which is applicable, the maximum number of frankings being attained well before the limit relative to the duration of use provided for the cartridge. Now, at the end of the guarantee period, the ink cartridge is often not completely empty (particularly if the postal indicia is not overelaborate), and may therefore still allow a certain number of frankings. However, if the user decides to continue frankings, it does so at its own risk without any guarantee and therefore also without any recourse against its franking system distributor, its ink cartridge supplier, in the event of its mailpieces subsequently being rejected by the Postal Service.

It is an object of the present invention to overcome this drawback and to avoid any risk of rejection by the Postal Service, by proposing a system for guaranteeing the quality of print of postal indicia. Another object of the invention is to allow such guarantee to be obtained whatever the type of franking system, electromechanical or computer-related, used.

SUMMARY OF THE INVENTION

These objects are attained by a process for recording an extension of guarantee of print for a system for franking mailpieces, characterized in that it comprises the following steps:

- display of an indication of "end of initial guarantee" at the level of the franking system,
- comparison of a remaining volume of ink with a minimum volume of ink beyond which it is prohibited to print the mailpieces,
- if the remaining volume of ink permits, display of an indication "offer of extension of guarantee" at the level of the franking system,
- if this offer is accepted by the user of the franking system, link with a server of the franking system distributor, and
- recording of the extension of guarantee in the distributor's server.

With the present invention, the user thus optimalizes the use of its postal ink cartridges, as it may effect prints virtually up to the extreme minimum threshold of use of these cartridges, with the guarantee that such prints will not be rejected by the Postal Service.

The indication of end of initial guarantee corresponds to the franking of a predetermined number of mailpieces, for example 20000.

The link with the distributor's server is effected either automatically by the franking system via a specialized communication link or by means of a computer terminal independent of the franking system and linked to the Internet network.

The recording of the extension of guarantee in the distributor's server is preferably followed by the communication by the distributor's server of a certificate of guarantee either to the franking system or to the computer terminal. This certificate of guarantee comprises an additional number of frankings authorized, for example 10000.

According to a particular form of embodiment, the comparison of the remaining volume of ink with a minimum volume of ink is effected at the level of the distributor's server and not at the level of the franking system.

BRIEF DESCRIPTION OF THE DRAWINGS

The invention will be more readily understood on reading the following description given by way of non-limiting example, with reference to the accompanying drawings, in which.

DESCRIPTION OF PREFERRED EMBODIMENT

Figure 1:
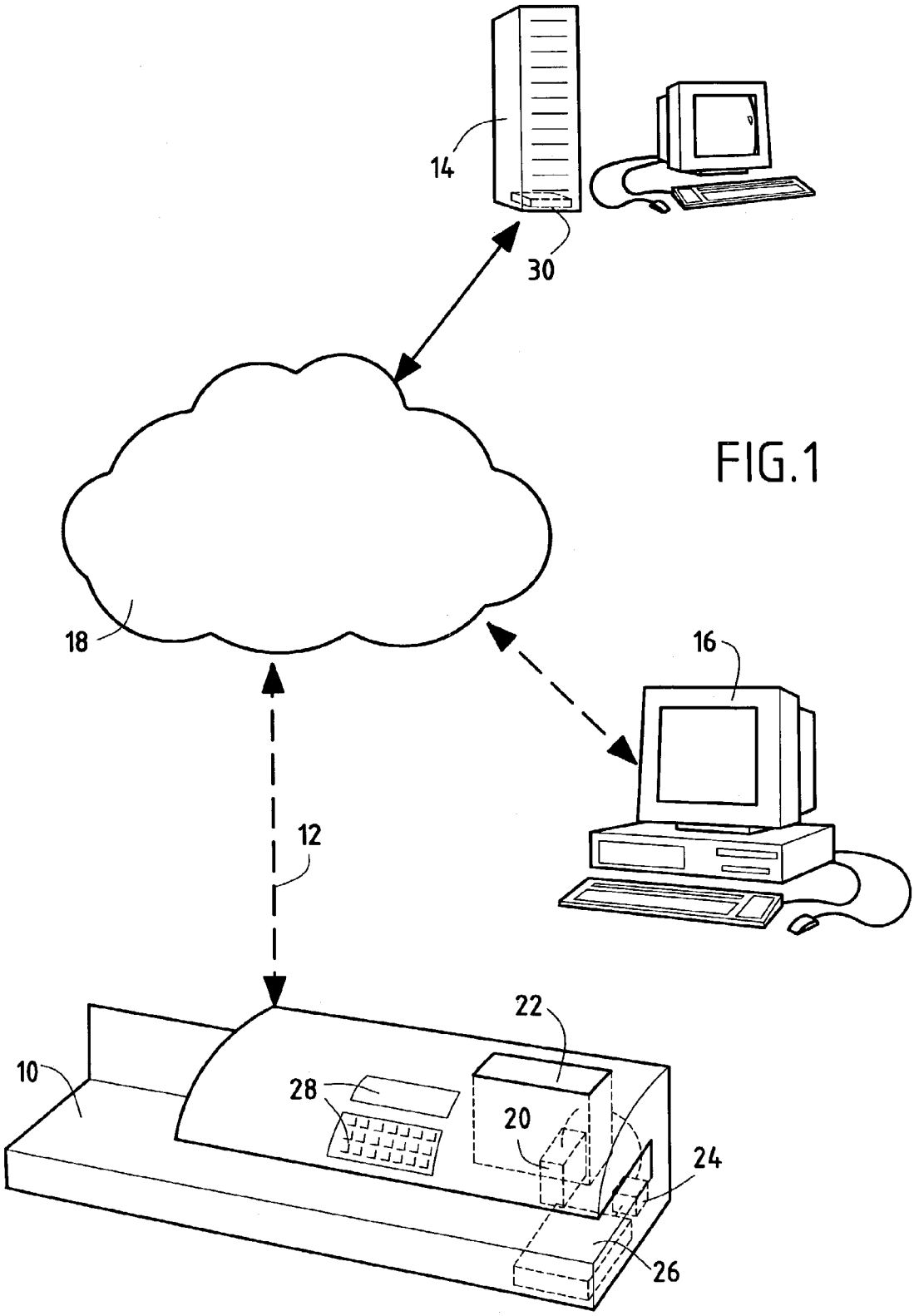
FIG. 1 schematically shows a franking system according to the invention employing a system of guarantee of the quality of print of postal indicia.

Referring now to the drawings, FIG. 1 schematically illustrates a franking system which may or may not be linked to a server of the distributor of this system.

This system of franking is for example a machine 10 of electromechanical type for franking mailpieces, linked, via a specialized line 12 to a server 14 of the distributor of this machine. In order to benefit from the guarantee of the system of the invention, the user must, if this system is not linked directly to the server, at least have available a data-processing assembly, for example a personal computer 16 linked via a communication network 18, preferably the Internet network, to the distributor's server 14.

Mailpiece is understood to mean both an envelope (of any format) and a label intended thereafter to be stuck on a thick envelope or a parcel.

This machine for franking mailpieces is of conventional design and does not require any particular description. In order to understand the invention, it should simply be noted that it comprises means 20 for printing postal indicia; means for feeding these printing means with postal ink, conventionally constituted by a postal ink cartridge 22; known means 24 for detecting a minimum ink level of this cartridge beyond which no printing can be effected (overstepping this threshold will block the franking machine); likewise known control and monitoring means 26 (more particularly incorporating memory and microprocessor) for managing the franking machine; and user-interface means 28 with screen and keyboard for example. Optionally, this machine may also comprise interface means (not shown) of modem type with a specialized line 12 when such a communication link is possible.

The distributor's server 14 is a conventional server with specific but conventional software means for controlling the franking operations and possibly the reloading with a postal credit. Within the framework of the invention, it further comprises complementary software means 30 allowing management of the guarantee granted to the user in accordance with the operating principle described hereinbefore.

Similarly, the data-processing assembly 16 is a traditional computer but comprising software means (essentially a navigator) allowing to access to the Internet network and therefore a consultation of the website of the franking machine distributor.

Figure 2:
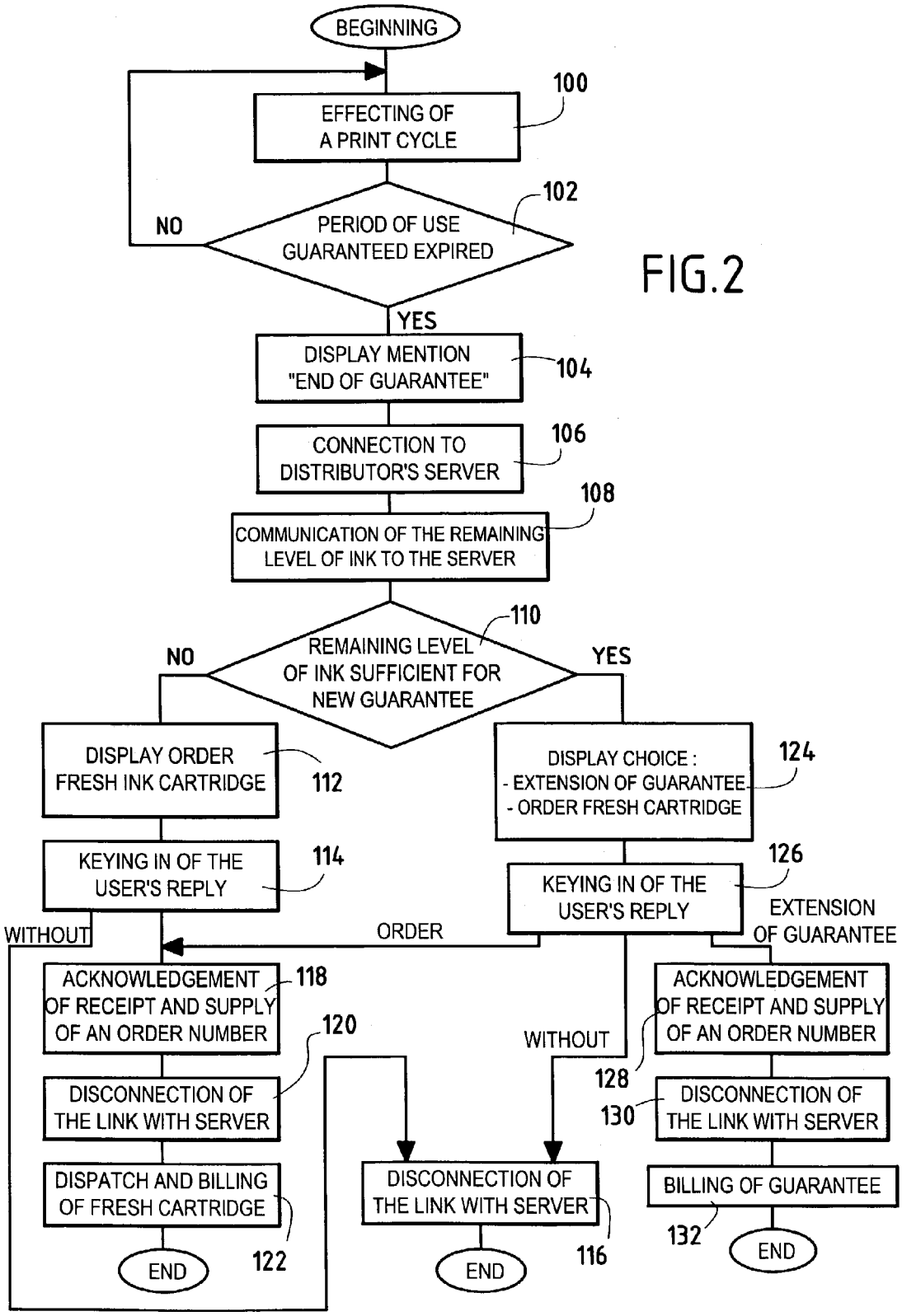
FIG. 2 is a flow chart explaining the functioning of the guarantee system of FIG. 1.

The principle of the system of guarantee granted to the user by the distributor is illustrated by the flowchart of FIG. 2.

During the initial guarantee period, and as a function of its requirements, the user effects a first print cycle (step 100), then subsequent cycles until the number of guaranteed prints (for example 20000) is attained (reply YES to the test of step 102). An indication specifying the end of initial guarantee of print is then displayed at the level of the franking machine, in a following step 104.

If the franking machine is a connected machine, i.e. if it has a communication link (via a modem) with the distributor's server, the franking machine automatically proceeds, in a following step 106, with a connection to this server and with a coded exchange of information between the franking machine and the server in which the level of ink remaining in the postal ink cartridge is transmitted in particular, in a step 108 (among other information transmitted, the number of machine, the type of cartridge used, will be noted).

If the server considers that the remaining level of ink is not sufficient for the attribution of a fresh guarantee (reply NO to the test of step 110), it will display on the screen of the franking machine, in a step 112, an invitation to order a fresh cartridge of postal ink, which the user may or may not accept, in a step 114 following immediately, by entering in its reply via the keyboard of the franking machine. Depending on the option taken by the user, the server will, in a step 116, simply disconnect the link with the franking machine (no order from the user) or acknowledge receipt of the order (step 118) and then interrupt the link (following step 120), the dispatch of the ordered cartridge and billing thereof being effected off line by the distributor in a subsequent step 122.

On the contrary, if the server considers that the remaining level of ink is sufficient for the attribution of a fresh guarantee (reply YES to the test of step 110), it will display on the screen of the franking machine, in a step 124, a choice for the user between the order of a fresh cartridge or the purchase of an extension of guarantee. Depending on the user's reply made in a following step 126, the server may, as hereinabove, disconnect the link (return to step 116) or accept the order and interrupt the link (return to steps 118 and 120) or, if the user chooses to accept the extension of guarantee, it may display on the screen of the franking machine, in a step 128, a certificate of guarantee recalling the conditions of its guarantee (number of additional frankings guaranteed, for example 10000, and corresponding guarantee number) and then interrupt the link (step 130), billing of the guarantee being subsequently addressed by the distributor to the user off line in an ultimate step 132.

Of course, these different purchases, orders of cartridges or extensions of guarantee are only made insofar as the user's account with the distributor is funded or forms part of a service contract relative to the consumables allowing it such purchases. In principle, they are privileged users whose customer profile is followed very regularly by the distributor. The following, particularly interesting variant will be noted, in which the remaining volume of ink is compared with the minimum volume directly at the level of the franking system, which comparison will determine the display of the choice, or not, between the order of a fresh cartridge or the extension of the guarantee. In effect, in that case, the link to the server is effected only if the user of the franking system decides on the extension of its guarantee and therefore needs this link to communicate the characteristics of its franking system and obtain its certificate of guarantee.

When the franking machine is not connectable to a server through a specialized line, this extension of guarantee can nonetheless be taken out if the user can be linked to the distributor's website. In effect, in that case, the display of the end of guarantee on the screen of the franking machine is accompanied by a display of the volume of ink remaining in the postal ink cartridge (absolute display, in percentage or by a code). In this way, when the user is connected to the distributor's website via any data-processing assembly linked to the Internet network (for example a personal computer or a telephone-PDA) and accesses its personal account with this distributor (after keying in a user name and a password), it will communicate to the distributor's server the value furnished by its franking machine and, as a function of this value, will have the choice between the order of a fresh cartridge or an extension of guarantee, as hereinabove, proposed by a display on the screen of its data-processing assembly. Depending on the option chosen, it may continue to print postal indicia with its present cartridge under the guarantee of the distributor or change this cartridge for a fresh one which will be dispatched to it and billed by the distributor. Of course, if the cartridge has not attained its minimum threshold beyond which the machine is blocked, and if the user does not change it or does not purchase the extension of guarantee, it may still print, but in that case without any guarantee of the distributor as to the quality of print of the postal indicia thus marked. In this configuration of non-connected machine, the particularly interesting variant should also be noted in which the volumes of ink are compared at the level of the franking system rendering the exchange of the value representative of the remaining volume of ink unnecessary. It is therefore only if the user wishes to benefit from the extension of its guarantee that it will connect to the distributor's server in order to obtain its certificate of guarantee.

With the invention, the user can thus optimalize the use of its ink cartridges without risking a rejection of its mailpieces by the Postal Service, the quality of print of its postal indicia always being guaranteed by the distributor of its franking machine.

What is claimed is:

1. A process of recording an extension of guarantee of print for a system for franking mailpieces, wherein the process comprises the following steps of:

displaying an indication of an end of initial guarantee at the level of the franking system, comparing a remaining volume of ink with a minimum volume of ink below which printing of the mailpieces is prohibited, when it is determined that the remaining volume of ink is at or above the minimum volume, displaying an indication of offer of the extension of guarantee at the level of the franking system, linking the franking system with a server of a franking system distributor upon acceptance of the offer, and recording the extension of guarantee in the distributor's server.

2. The process of recording of claim 1, wherein the indication of the end of initial guarantee corresponds to the franking of a predetermined number of mailpieces.

3. The process of recording of claim 1, wherein the link with the distributor's server is effected automatically by the franking system through a specialized communication link.

4. The process of recording of claim 3, wherein the recording of the extension of guarantee in the distributor's server is followed by the communication by the distributor's server of a certificate of guarantee to the franking system.

5. The process of recording of claim 4, wherein the certificate of guarantee includes a number of additional frankings authorized.

6. The process of recording of claim 1, wherein the link with the distributor's server is effected by means of a computer terminal independent of the franking system and linked to the Internet network.

7. The process of recording of claim 6, wherein the recording of the extension of guarantee in the distributor's server is followed by the communication by the distributor's server of a certificate of guarantee to the computer terminal.

8. The process of recording of claim 1, wherein comparison of the remaining volume of ink with a minimum volume of ink is effected at the level of the distributor's server.

9. A system of recording an extension of guarantee of print for a franking system for franking mailpieces, wherein the system comprises:

means for displaying an indication of an end of initial guarantee at the level of the franking system, means for comparing a remaining volume of ink with a minimum volume of ink below which printing of the mailpieces is prohibited, means for displaying an indication of an offer of the extension of guarantee at the level of the franking system when the comparing means determines that the remaining volume of ink is at or above the minimum volume, means for linking the franking system with a server of a franking system distributor, upon acceptance of the offer by a user of the franking system, and means for recording the extension of guarantee in the distributor's server.

10. The system of recording of claim 9, wherein the linking means comprises a specialized communication line linked directly to the franking system.

11. The system of recording of claim 9, wherein the linking means comprises a computer terminal independent of the franking system and linked to an Internet network.

* * * * *